US009694480B2

(12) United States Patent
Brown

(10) Patent No.: US 9,694,480 B2
(45) Date of Patent: Jul. 4, 2017

(54) NUT DRIVING CLEANING SYSTEM

(71) Applicant: Michael Brown, Salado, TX (US)

(72) Inventor: Michael Brown, Salado, TX (US)

( * ) Notice: Subject to any disclaimer, the term of this patent is extended or adjusted under 35 U.S.C. 154(b) by 340 days.

(21) Appl. No.: 14/532,008

(22) Filed: Nov. 4, 2014

(65) Prior Publication Data

US 2016/0121469 A1 May 5, 2016

(51) Int. Cl.
*B25B 23/12* (2006.01)
*B25B 13/06* (2006.01)

(52) U.S. Cl.
CPC ..... *B25B 23/12* (2013.01); *B25B 13/06* (2013.01)

(58) Field of Classification Search
CPC ..... B25B 13/06; B25B 23/12
USPC ..... 81/125
See application file for complete search history.

(56) References Cited

U.S. PATENT DOCUMENTS 1,645,753 A * 10/1927 Hanson ..... B25B 23/10 81/457
2,671,484 A * 3/1954 Clark ..... B25B 23/12 7/901
7,654,175 B2 * 2/2010 Hamon ..... B25B 13/102 81/124.5
8,695,461 B2 * 4/2014 Moss ..... B25B 13/06 81/125
2006/0254394 A1 * 11/2006 Cantlon ..... B25B 23/12 81/125

* cited by examiner

*Primary Examiner* — Hadi Shakeri
(74) *Attorney, Agent, or Firm* — Warren V. Norred; Norred Law, PLLC

(57) ABSTRACT

The present invention is a nut-driving apparatus and method that comprises a shank with an embedded magnet mounted at the end and a spring-loaded socket mounted above the magnet, which when pulled, separates the socket from the magnet, releasing any attracted metal shavings to allow for easy cleaning.

2 Claims, 4 Drawing Sheets

FIG 4A and FIG 4B
FIG. 4A
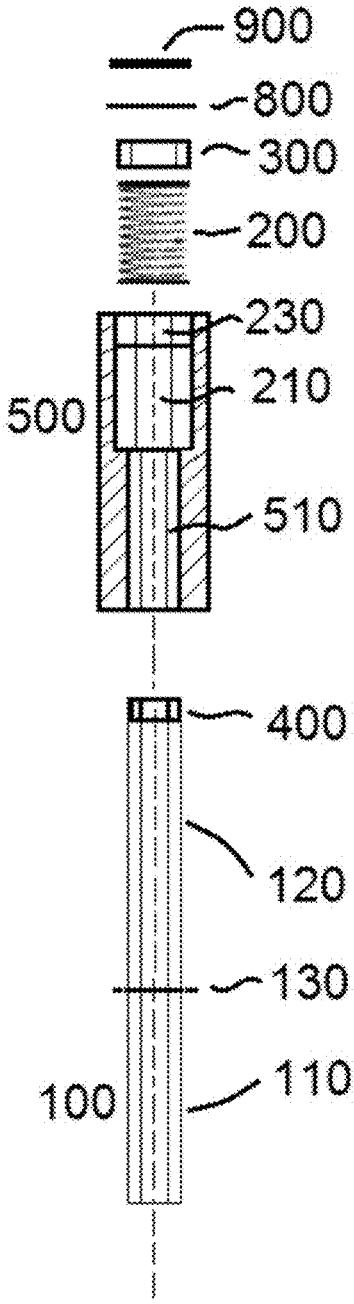
FIG. 4B
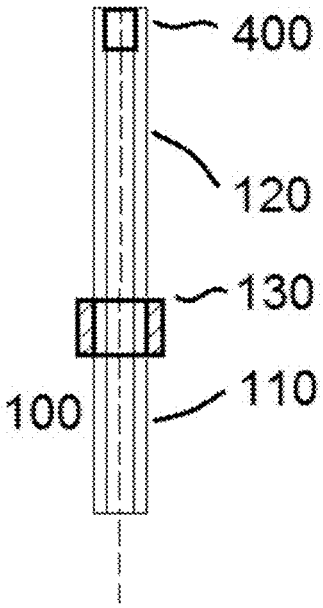

NUT DRIVING CLEANING SYSTEM

TECHNICAL FIELD OF THE INVENTION

The field of the invention concerns machine nut drivers and sheet metal screws.

BACKGROUND OF THE INVENTION

Machine mechanics often use machine metal screw fasteners.

Metal screws are defined and ordered in industry by to screw size, thread count, length, and head style. For example, one common standard screw is defined as a 8-32×1 pan head, meaning a size eight screw with 32 threads per inch, one inch long screw, with a pan head.

Irrespective of what type of head a screw uses, builders must employ some method to start the screw into the sheet metal. Some screws are self-tapping, with a notched tip that acts as a drill bit to drive the screw and keep thin metal from denting. Non-self-tapping screws require a pilot hole drilled in order to prevent splitting within the materials being fixed together.

Metal screws are self-threading and create metal shavings as the screws enter sheet metal. These shavings are often collected by a magnet that is part of the driver. One such example in the prior art is described in U.S. Pat. No. 8,695,461 to Moss, which allows a user to pull the socket portion of the driver away from the magnet.

As the shavings of the metal are collected by the magnet driver of the aforementioned prior art, the shavings accumulate at the head of the driver, inside the socket, and interfere with the driver operation. When enough shavings accumulate, the driver becomes unusable until the socket is cleaned.

To empty the device disclosed in Moss '461, the socket is pulled back, and a user must clean the metal shavings from the magnet. Removing the shavings from the magnet necessitates physically grasping each shaving and pulling it from the driver magnet. Because each metal shaving is small, users struggle to fully dislodge all the shavings.

The metal-working industry would benefit from a nut-driving system that allows for easy separation of driver from the collected shavings.

SUMMARY OF THE INVENTION

The present invention is a nut-driving apparatus and method that comprises a shank with an embedded magnet mounted at the end and a spring-loaded socket mounted above the magnet, which when pulled away from the shank, separates the socket from the magnet, releasing any attracted metal shavings to allow for easy cleaning of the socket.

Other features and advantages of the present disclosure will be apparent to those of ordinary skill in the art upon reference to the following detailed description.

DETAILED DESCRIPTION OF THE INVENTION

While the making and using of various embodiments of the present disclosure are discussed in detail below, it should be appreciated that the present disclosure provides many applicable inventive concepts, which can be embodied in a wide variety of specific contexts. The disclosure is primarily described and illustrated hereinafter in conjunction with various embodiments of the presently-described systems and methods. The specific embodiments discussed herein are, however, merely illustrative of specific ways to make and use the disclosure and do not limit the scope of the disclosure.

DESCRIPTION OF THE DRAWINGS

FIG. 4A is a cross-section view of one embodiment of the invention.

FIG. 4B shows a cross-section view of the embodiment of the invention as in FIG. 4A, but with a second embodiment of the Lower Retainer 130 and Magnet 400.

DETAILED DESCRIPTION OF THE INVENTION

Figure 1:
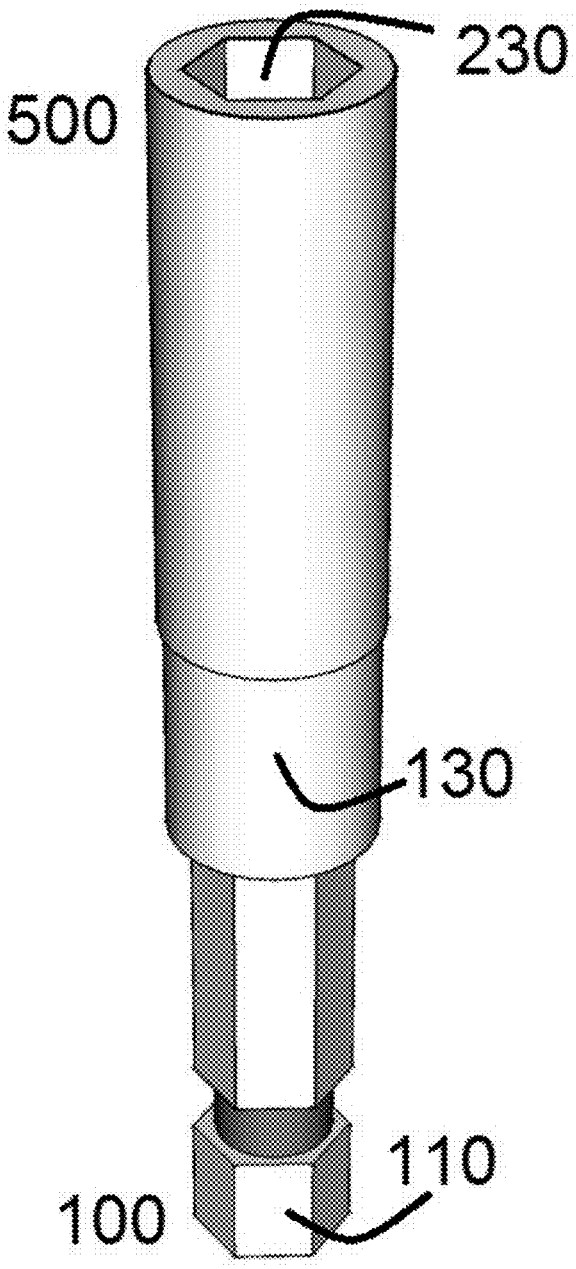
FIG. 1 is an orthogonal view of one embodiment of the invention in the "normal" position.

The current embodiment of the disclosed invention is a nut driver system comprising a Mounting Body 100, the Shank 110, Driving Spindle 120, Lower Retainer 130, Compression Spring 200, Spring Cavity 210, Nut Cavity 230, Centering Bushing 300, Magnet 400, Driving Body 500, Guide 510, Upper Retainer 800, and Barrier Plate 900, described supra, and shown in the drawings.

As shown in each of the figures, the Mounting Body 100 is the foundation on which all other components are mounted, either directly or indirectly.

As shown on the figures, the Mounting Body 100 has two ends. One end, known as the Shank 110, is hexagonal in the current embodiment, and designed to be connected to a drill using construction techniques well-known in the art. The Shank 110 does not require a hexagonal construction, but this is the standard construction for drill bits and other instruments driven by drills.

A Lower Retainer 130 is a raised section of the Shank 110, positioned on the Mounting Body 100 such that a user has sufficient length of Shank 110 to install the invention into a drill or other driving mechanism. Current embodiments use either a cylindrical metal piece of a similar diameter of the Driving Body 500 (described below) for esthetics (seen in FIGS. 1, 2, 3A, 3B, and 4B), or a simple snap ring (as seen in FIG. 4A).

As shown on the drawings, the second section of the Mounting Body 100, opposite of the Shank 110, is a round or hexagonal Driving Spindle 120, which may or may not be the same cross-sectional shape of the Shank 110.

As seen in the figures, a Magnet 400 is mounted into a cavity in the top of the Driving Spindle 120 (FIG. 4B), or on its end (FIG. 4A). The Magnet 400 polarity is irrelevant for mounting purposes. FIG. 4A shows one embodiment of the invention in which the Magnet 400 is affixed by glued or other attachment onto the top of the Driving Spindle 120, or affixed to the Driving Spindle 120 using many methods. The cavity-construction is beneficial because the inventor has found that a press-fit construction protects the Magnet 400 and holds it in place well.

Figure 2:
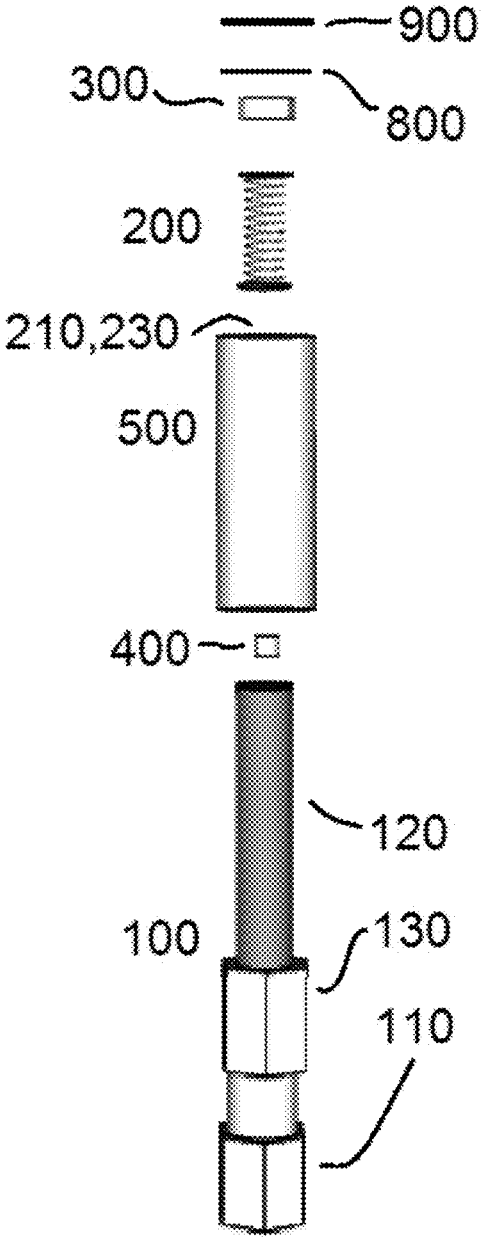
FIG. 2 is an exploded view of one embodiment of the invention.

The Spring 200 is mounted on the Driving Spindle 120, held in place by the Spring Cavity 210 interior section of the Driving Body 500, as shown in FIG. 2-4.

A Centering Bushing 300 is installed on the top of the Driving Spindle 120, as shown in FIG. 2-4. The Centering Bushing 300 is installed on the Driving Spindle 120 during the assembly process after the Driving Body 500 is positioned on the shaft of the Driving Spindle 120.

As shown in FIG. 2-4, the Centering Bushing 300 is the same diameter as the Spring Cavity 210, and when installed, prevents a user from damaging the invention by providing a hard stop to movement of the Driving Body 100, and to prevent excessive play in the motion of the Driving Body 100 with respect to the Driving Body 500.

A Driving Body 500 is mounted on the Driving Spindle 110. The interior of the Driving Body 500 has two sections. As shown in FIG. 2-4, one end of the Driving Body 500 has an interior hexagonal construction that matches the hexagonal shaft of the Shank 100. This interior hexagonal interior is known as the Guide 510. The other interior end of the Driving Body 500 has a larger hexagonal cross-section and called the Spring Cavity 210.

The Lower Retainer 130 provides a hard stop to the movement of the Driving Body 500 in the direction of the Shank 110 portion of the Mounting Body 100.

FIGS. 1, 2 3 and 4B show a cylindrical element serving as the Lower Retainer 130 that is roughly the same diameter as the Driving Body 500. FIG. 4A shows a different embodiment that uses a thin snap ring as the Lower Retainer 130.

Figures 3A, 3B:
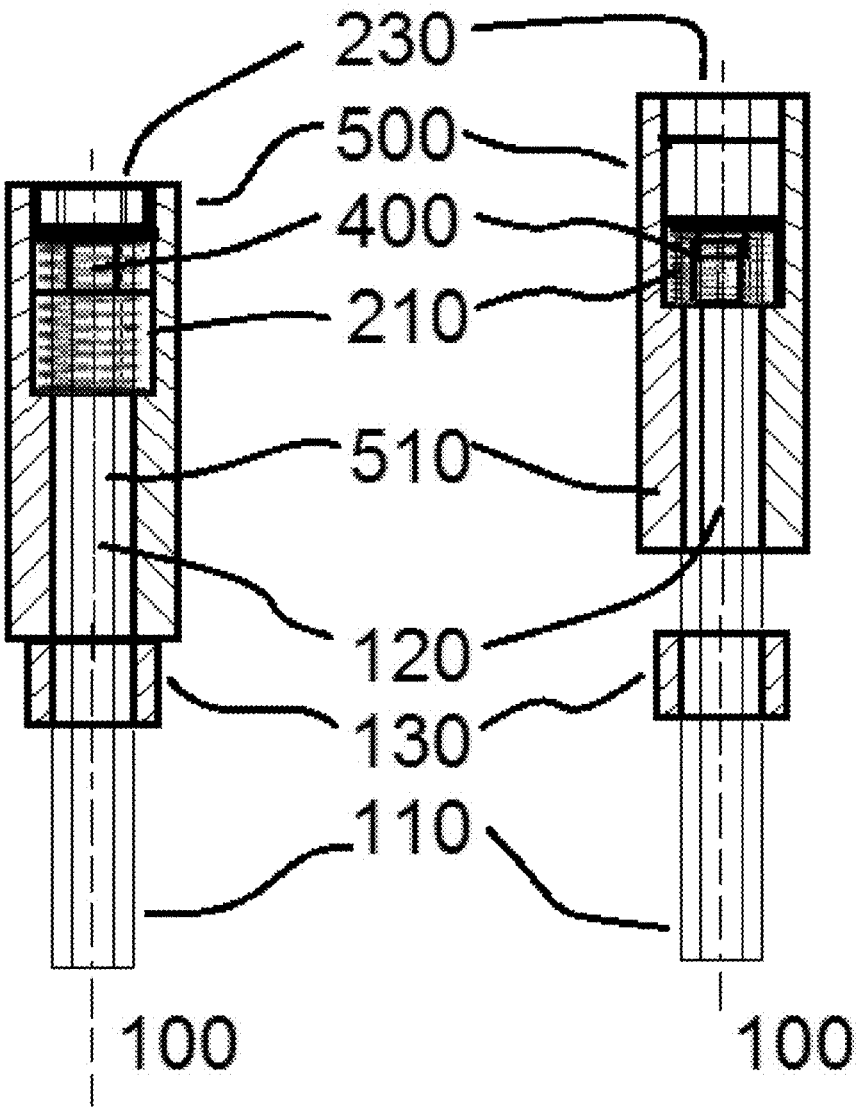
FIGS. 3A and 3B are cross-sectional views of one embodiment of the invention in the "normal" and "open" positions, respectively.

The Spring 200 is mounted in the Spring Cavity 210. The differing interior constructions between the Spring Cavity 210 and the hexagonal Guide 510 sections of the Driving Body 500 keeps the Spring 200 in place, because the Spring 200 has round coils that are too large to escape into the smaller-dimensioned Guide 510 section, as shown in FIGS. 3A, 3B, and 4A.

An Upper Retainer 800, typically a snap ring, is mounted in the Spring Cavity 210, as shown on FIG. 2-4. Once installed, The Upper Retainer 800 establishes the position of the Spring 200.

An optional Barrier Plate 900, currently consisting of a non-metallic material covering exterior side of the Upper Retainer 800 (typically a snap ring), provides separation between metal shavings and the device. As shown in FIG. 2-4, the Barrier Plate 900 is set into a groove on the inside of the Spring Cavity 210, creating a Nut Cavity 230 in which the user can place a machine screw. The Barrier Plate 900 protects the Nut Cavity 230 from damage and excessive wear from the motion of the Driving Body 500 against metal screws as they are driven.

The invention allows movement of the Driving Body 500 with respect to the Mounting Body. In use, the invention has two effective positions.

The "normal" position, shown in FIGS. 1 and 3A, is a reference to the invention as it sits without any manipulation by a user. The invention is maintained in the normal position by the Spring 200 pushing the Driving Body 500 in the direction of the Shank 110. The invention is in the normal position while a user is driving a nut with a drill or other rotating device.

The "cleaning" position, shown in FIG. 3B, is a temporary configuration occurring when a user uses his figures to pull the Driving Body 500 away from the Shank 110 end.

While the invention is in the cleaning position, the Spring 200 is compressed, as shown in FIG. 3B. The Magnet 400 is pulled away from the Nut Cavity 230 because the Magnet 400 is installed on the Mounting Body 100 at the end of the Driving Spindle 110. Because magnetic force varies as the square of the distance, even a small separation between the Magnet 400 and the metal shavings adhering to the Nut Cavity 230 will cause the shavings to fall from the invention, or diminish the force holding them in or around the Nut Cavity 230 such that they are easily removed.

One of the major differences between this invention and the prior art is that, in the disclosed invention, the user cleans the socket of metal shavings by pulling the socket within the Driving Body 500 away from the Magnet 400, as opposed to the prior art devices, in which the Nut Cavity 230 is pulled back so a user can clean the metal shavings which are held in place by the magnet. The construction disclosed herein reduces the magnetic hold of the shavings to the Magnet 400 so cleaning takes minimal effort.

Modifications are intended to be within the invention as disclosed. For example, the Lower Retainer 130 can be a snap ring, or a larger press-fit cylinder to match the appearance of the Driving Body 500. The Nut Cavity 230 has been discussed as a to driver for hexagonal nut heads, but the invention can be designed to drive slotted-head screws, Philip-head screws, or all manner of other screw heads, including an interchangeable head element so any type of metal screw head can be driven by the invention.

Thus, while the invention has been illustrated and described in details in the drawings and foregoing description, the same is to be considered as illustrative and not restrictive, it being understood that only certain embodiments have been shown and described, and modifications that come within the spirit of the inventions as described herein and by the following claims are desired to be protected.

The invention claimed is:

1. A nut-driving system, comprising:

a) a mounting body, including:
- a rear portion defining a shank;
- a front portion defining a driving spindle;
- a centering bushing, defined by a thin circular bushing fitted on a front end of the driving spindle;
- a magnet mounted into a cavity at the front end of the driving spindle;
- a lower retainer, positioned on the shank;

b) a driving body, hollow cylindrical and slideably connected over the mounting body's driving spindle, wherein the lower retainer provides a stop to a sliding movement of the driving body in the direction of the shank, the driving body constructed with two internal bore portions forming a step therebetween, including a first internal bore portion defining a guide portion which matches an exterior shape of the driving spindle and slideably connects the driving body with the mounting body so that the driving body can slide between a rear position established by the lower retainer defining a normal position, and a front position defining a cleaning position and a second bore portion defining a spring cavity and a nut cavity;
- an upper retainer mounted in the spring cavity; and
- a groove formed inside of the spring cavity of the driving body and a barrier plate positioned into the groove forming the nut cavity about an external end of the second bore;
- the nut cavity located at an end of the driving body and defining a head adapted to receive and drive screw heads; and c) a compression spring, mounted on the driving spindle set within the spring cavity, seated between the upper retainer and the step so that the spring pushes the driving body toward the lower retainer to said normal position.

2. A nut-driving system as in claim 1, wherein the barrier plate is constructed of a non-metallic material.

* * * * *